United States Patent [19]

Battcock

[11] 4,063,589

[45] Dec. 20, 1977

[54] HEAT EXCHANGER ASSEMBLIES

[75] Inventor: Whalley Vowe Battcock, Newport Pagnell, England

[73] Assignee: Coal Industry (Patents) Limited, London, England

[21] Appl. No.: 727,618

[22] Filed: Sept. 28, 1976

Related U.S. Application Data

[62] Division of Ser. No. 557,403, March 11, 1975, abandoned.

[30] Foreign Application Priority Data

Mar. 21, 1974 United Kingdom ..... 12611/74

[51] Int. Cl.[2] ..... F28D 13/00

[52] U.S. Cl. ..... 165/104 F; 34/57 A; 165/163

[58] Field of Search ..... 165/104 F, 163; 34/57 A

[56] References Cited

U.S. PATENT DOCUMENTS 2,657,473 11/1953 Montgomery et al. ..... 34/57 A X
2,914,388 11/1959 Kelley ..... 165/104 F X

FOREIGN PATENT DOCUMENTS 1,065,698 4/1967 United Kingdom ..... 165/163

*Primary Examiner*—Albert W. Davis, Jr.
*Attorney, Agent, or Firm*—Stevens, Davis, Miller & Mosher

[57] ABSTRACT

A heat exchanger of annular cross-section and having outer and inner concentric walls has arranged within its annular space a plurality of tubes each of the same involute form. The tubes may be arranged in layers within the space and in one embodiment a fluidized bed of particulate material can be supported within the space with the tubes immersed within the bed. The tubes constitute a fluid path through the space for heat exchange as a fluid, in use, passes therethrough.

5 Claims, 8 Drawing Figures

HEAT EXCHANGER ASSEMBLIES

This is a Division of application Ser. No. 557,403 filed Mar. 11, 1975, now abandoned.

The present invention relates to heat exchanger assemblies. Particularly, the invention has reference to the form of heat exchange tubing arranged within such assemblies.

It is known to provide heat exchanger assemblies of circular or annular form and in the latter case to arrange tubing radially within the annular heat exchange space. However, with a heat exchanger of annular form especially one in which the tubing is to be immersed within a fluidised bed supported within the space, two desirable requirements of the tubing arrangement arise. The first is that the depth of the fluidised bed should be as shallow as possible and this necessarily implies that the spacing of the tubing should be close and uniform, consistent with satisfactory fluidisation of the bed. The second is that the length of the tubing should be uniform. In the past straight tubing has been employed in heat exchangers of annular form and, as mentioned above, disposed radially. The radial disposition, if effected to meet the first above mentioned desirable requirement, results in the tubing being of unequal length. Alternatively, if the radial disposition is so arranged as to meet the second desirable requirement, the first desirable requirement regarding the spacing of the tubing cannot be met.

It is therefore an object of the invention to provide a heat exchanger assembly having a tubing arrangement which substantially satisfies the two desirable requirements referred to above.

For this purpose, according to the invention a heat exchanger assembly includes a vessel and a group of heat exchanger tubes arranged within the vessel and each of the same involute form.

Preferably the evolute of the involute is a circle. The vessel may be of annular form, the outer and inner walls being of circular shape in cross section and the tubes extending between the outer and inner walls.

In one form of this invention the heat exchanger tubes, each bent to the same involute form are secured at their inner ends to the inner wall of the annular vessel and at their outer ends to the outer wall of the vessel so that a liquid or gaseous fluid to be heated or cooled may be passed through the tubes either from within the inner wall of the annular vessel to the space surrounding the outer wall or in the reverse direction.

According to a preferred feature of this form of the invention the tubes are arranged in a number of layers each of which is in a plane at right angles to the axis of the annular vessel. Each layer contains a number of tubes, each of which is equi-spaced throughout its length from the tubes, adjacent to it in the layer. The outer ends of the tubes may be bent so as to pass through the outer wall of the vessel radially, in which case the tube spacing is increased when the bends are made, or the outer walls may be shaped to facilitate the securing of the ends of the tubes to it.

The number of tubes in each layer is determined by the spacing of the tubes and the diameter of the circle from which the involute is evolved. This diameter may be the same as that of the inner wall of the annular vessel.

Any number of layers of tubes may be installed in the vessel and means for supplying the fluid to the tubes well known in heat exchanger practice may be used.

Thus any number of layers of tubes may be connected in parallel and groups of layers may be connected in series to provide a heat exchanger of any desired number of passes.

Small changes in the length of a tube in relation to the diameters of the inner and outer walls of the annular vessel can be accommodated by slight bending of the tube in the plane of the layer with a consequent slight departure from the initial involute form without the imposition of severe stress in the materials of construction.

All the tubes may be of involute form in the same sense (e.g. anti-clockwise) or alternatively adjacent layers or groups of layers may be of opposite sense. If adjacent layers are made of opposite sense the spacing of the layers of tubes along the length of the vessel may be made such that deflection in this direction of any tube in a layer is restrained by contact with the tubes in an adjacent layer. Spacing members may be attached to the tubes in the vicinity of the cross over points or the tubes may be made such that their radial thickness is greater at the possible points of contact than elsewhere to minimise the danger of any damage that might occur through contact between tubes.

With tubes in adjacent layers having their involute form in the same sense, adjacent layers may be arranged so that the tubes are in line longitudinally, alternatively a staggered arrangement may be adopted. With adjacent layers of opposite sense and closely spaced the arrangement of the inner ends of the tubes is preferably staggered.

In a second form of this invention heat exchanger tubes are installed in an annular vessel with the tubes in each layer of involute form so that each tube in a layer is equi-spaced from those adjacent to it but the ends of each tube are connected by 180° return bends to the ends of tubes in line in layers above and below it. One end of each tube in the first layer is connected to a header through which the fluid to be heated or cooled is supplied and one end of the tube in the last layer is connected to a header collecting the fluid. The headers may be either within and forming part of the inner wall of the annular vessel or surround the outer wall of the vessel.

The tubes in each layer may be staggered from those in adjacent layers so that, for example, the tubes in each fifth layer are in line and inter-connected in which case the end four layers are connected to the headers. In this way a closely spaced arrangement of tubes can be achieved without using return bends of unduly small radius.

The tubes in each assembly may be linked together by ties of suitable material for support and to facilitate assembly of the heat exchanger.

In use the vessel may be mounted with its axis vertical and contain a fluidised bed of particulate material in which the tubes are immersed. Air or combustion sustaining gas may be passed into the bed from a distributor below the tubes to react with fuel introduced into the bed and fluidise the particulate material. The gaseous products of combustion may leave from a space above the fluidised bed and carry away some of the heat generated by combustion but the major part of the heat generated is transferred to the fluid passing through the tubes. This fluid may be liquid or gaseous and the process may include the evaporation of a liquid within the tubes.

In applications in which combustion is effected at a pressure above atmospheric the vessel containing the fluidised bed and the associated equipment may be enclosed in a pressure vessel and the cylindrical shape of the fluidised bed is advantageous in minimising the size of the pressure vessel required to contain it.

An alternative use for the invention is the transference of heat from one stream of fluid to another stream, one stream passing through the tubular elements and the other over the tubes in the annular space between the inner and outer walls of the vessel. The process may include the evaporation of a liquid or the condensation of a vapour in either stream of fluid.

By way of example only, seven embodiments of a heat exchanger assembly according to the invention are described below with reference to the accompanying drawings in which.

Figure 1:
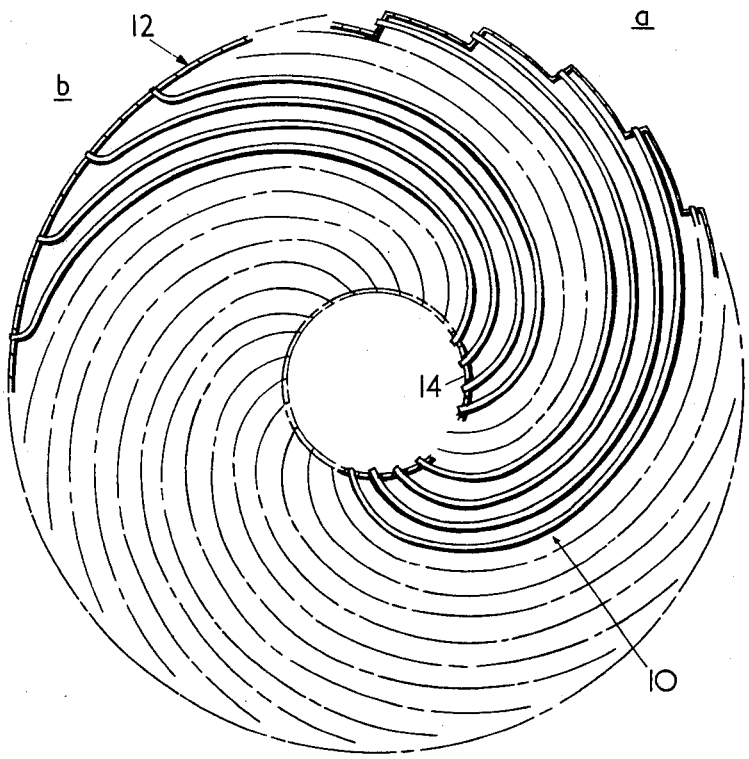
FIG. 1 is a simplified plan view of a first form of heat exchanger assembly.
Figure 7:
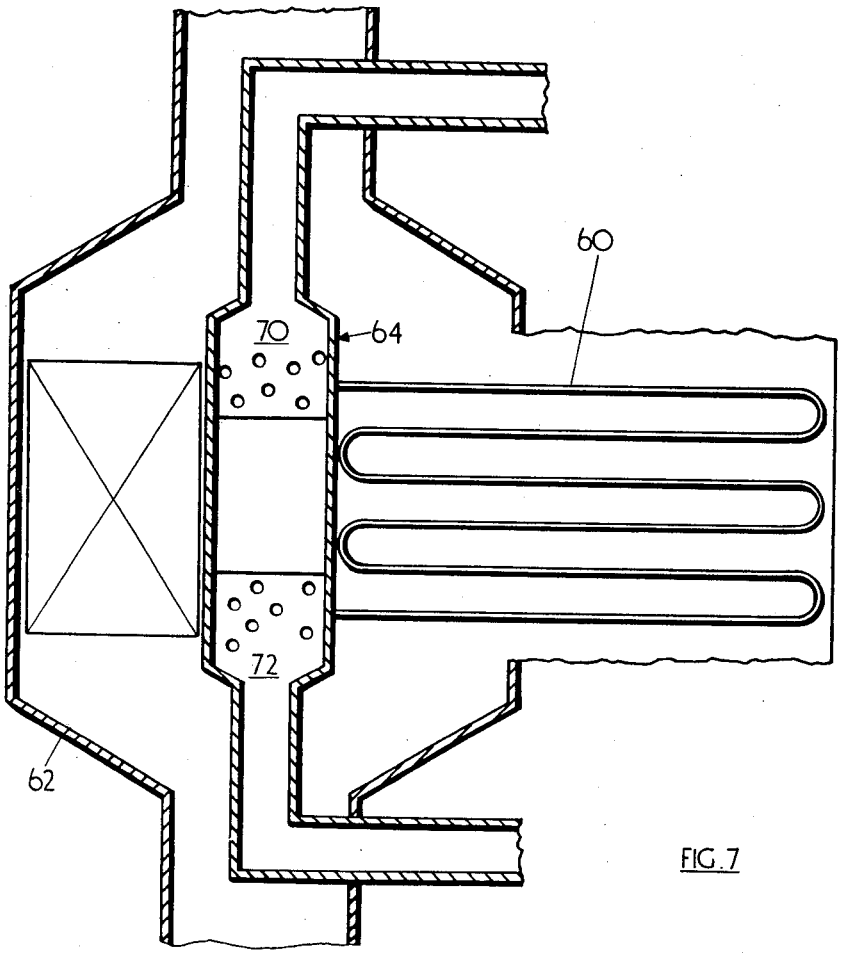
FIG. 7 is a sectional view of the sixth form of heat exchanger assembly shown in FIG. 6.

Referring to FIG. 7, the first form of heat exchanger assembly includes a vessel of annular cross-section defined by an inner wall 14 and an outer wall 12 which may be stepped as shown at *a* or may be of plain circular shape as at *b*. One layer of tubes 10 is shown and each tube is of involute form. A plurality of layers (not shown) is provided and the tubes in each layer are equispaced. The sense of the involutes of the tubes 10 is the same in each layer and in FIG. 1 the sense of the involutes is anti-clockwise. The tubes 10 in adjacent layers are aligned in the longitudinal direction of the vessel.

The tubes 10 in each layer are secured at their inner ends to the inner wall 14 which is of plain circular shape. At their outer ends, the tubes 10 are secured to the outer wall 12. With the alternative shape of the wall 12 shown at *a* the local step formation allows the tubes to be secured through the wall 12 without bending the tubes 10. The wall 12 having the plain circular shape as at *b* requires the outer ends of tubes 10 to be bent locally so as to enable them to pass approximately radially through the wall 12.

Figure 2:
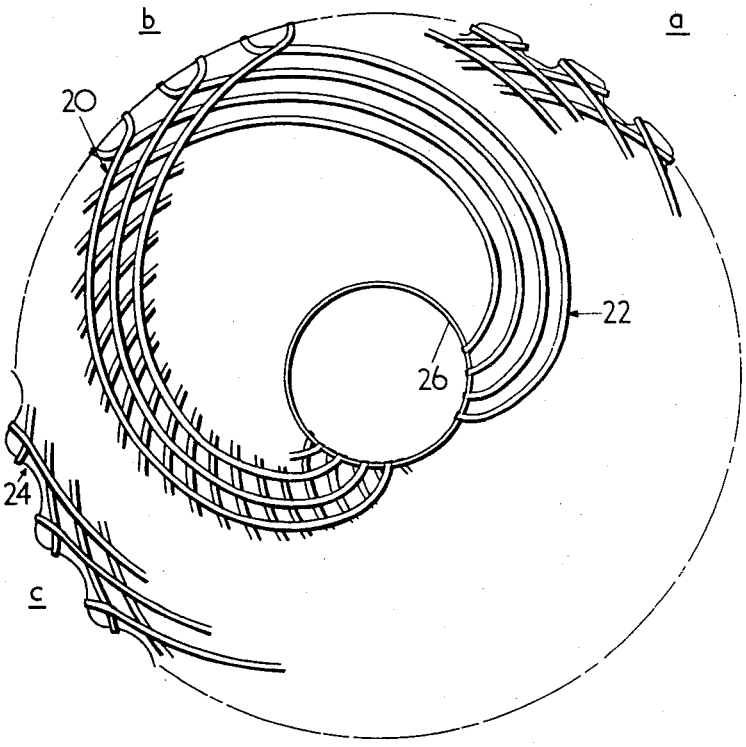
FIG. 2 is a simplified plan view of a second form of heat exchanger assembly.

With reference to FIG. 2, a heat exchanger assembly is shown and includes a vessel of annular cross-section having an outer wall 24 and inner wall 26. The outer wall 24 may be shaped as shown at *a* or *b* or *c* to provide alternative arrangements for securing tubes thereto. A plurality of layers of tubes are arranged within the vessel and two adjacent layers 20, 22 are depicted. The tubes in layer 20 are of involute form but are of the opposite sense to that of the tubes in adjacent layer 22; the sense of the involute of tubes of layer 20 is clockwise and the sense of the involute of tubes in layer 22 is anti-clockwise. The outer wall 24 as shown at *a* has corrugations that have sides approximately at right angles to the axes of the tubes where they meet the wall. At *b* the outer wall is of plain cylindrical shape, and in this alternative form of outer wall 24, the outer ends of the tubes are bent locally so that the tubes meet the wall approximately radially. The outer wall 24 as shown at *c* is corrugated and the tubes are bent at their outer ends to pass through the wall.

Figure 3:
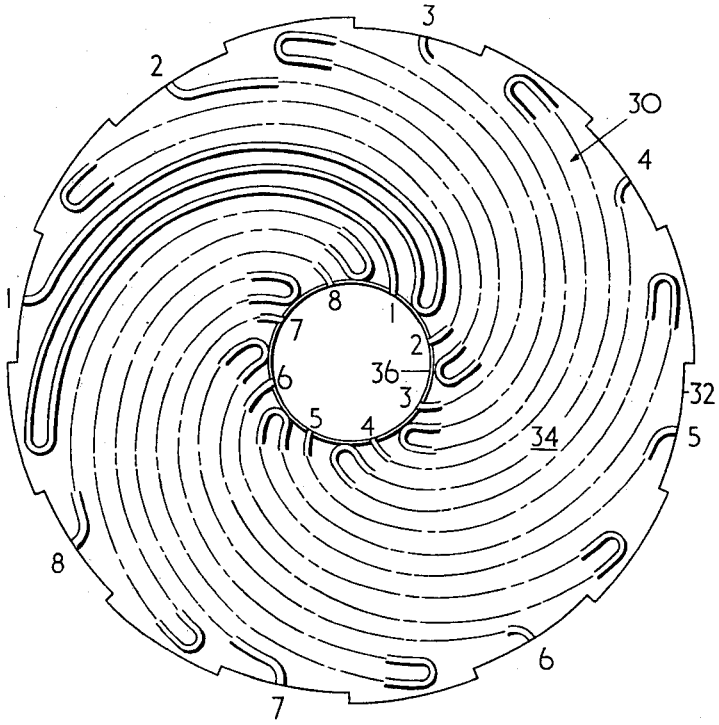
FIG. 3 is a plan view of a third form of heat exchanger assembly.

In FIG. 3 there is shown a third form of a heat exchanger assembly which includes a vessel of annular cross-section having an outer wall 32 and an inner wall 36 between which is defined a chamber 34. Involute tubes 30 are serpentine, each pass of the tube being of involute form, such that the tubes make more than one traverse of the chamber 34. The numerals 1.1, 2.2 etc. identify inlet and outlet ends of particular tubes.

Figure 4:
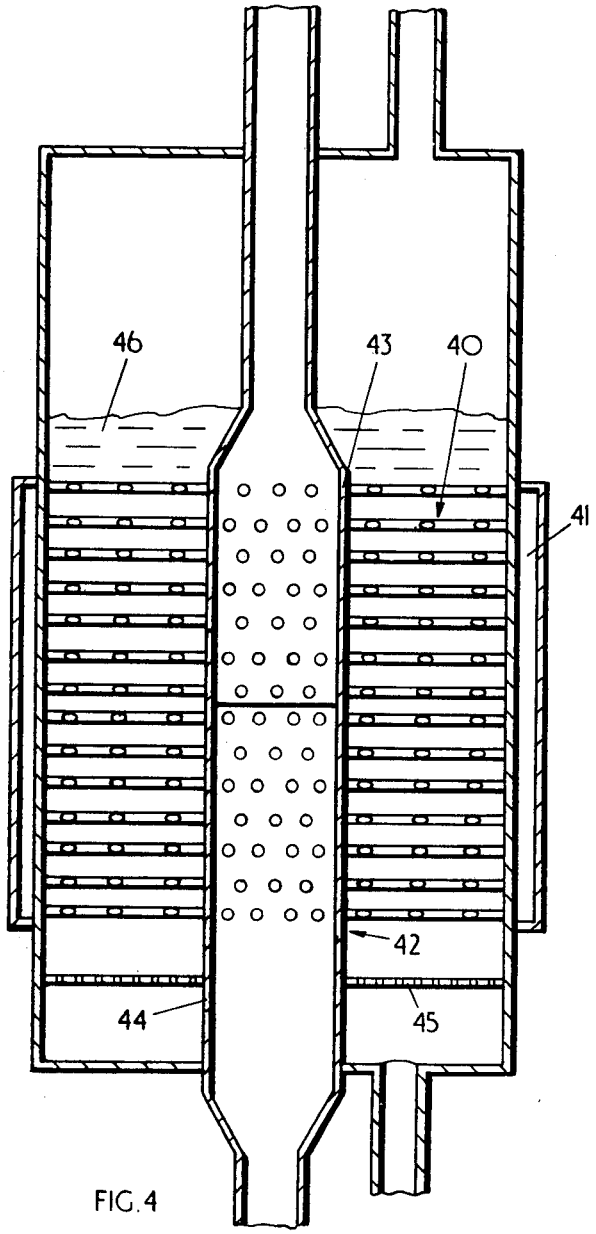
FIG. 4 is a vertical sectional view of a fourth form of heat exchanger assembly.

Referring now to FIG. 4, there is shown a heat exchanger assembly in the form of a fluidised bed combustor in which tubes 40 of involute form are installed in a two pass arrangement, the outer ends of the tubes being in communication with a common annular chamber 41 and the inner ends in communication with a cylinder 42 forming the inner wall of the annular vessel. The cylinder 42 is divided to form two headers 43, 44 from which fluid, in use, enters and leaves the tubes 40. Reference numeral 45 indicates a gas distributor plate of the combustor located between the outer and inner walls of the vessel towards the lower ends thereof as viewed in the drawing. A fluidised bed is shown at 46 supported by the plate 45.

Figure 5:
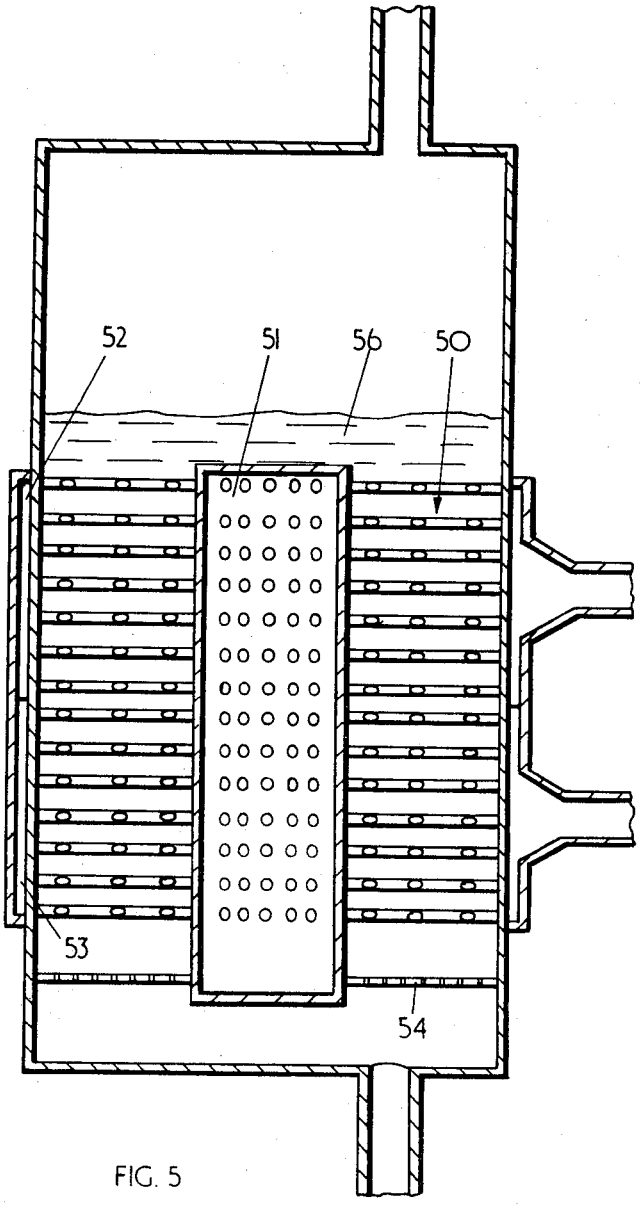
FIG. 5 is a vertical sectional view of a fifth form of heat exchanger assembly.

FIG. 5 shows a sectional view of a fifth form of heat exchanger assembly. In this figure, the assembly is a fluidised bed combustor in which tubes 50 of involute form are installed in a two pass arrangement, the inner ends of the tubes 50 being in communication with a tubular chamber 51 formed by the inner wall of the annular vessel and closed at both ends. The outer ends of tubes 50 communicate with an annular chamber circumjacent the outer wall of the vessel. The annular chamber is divided into two portions 52, 53 forming headers, a fluid, in use, entering through one and passing through the tubes 50 and chamber 5 and thence through the tubes 50 to leave through the other.

Figure 6:
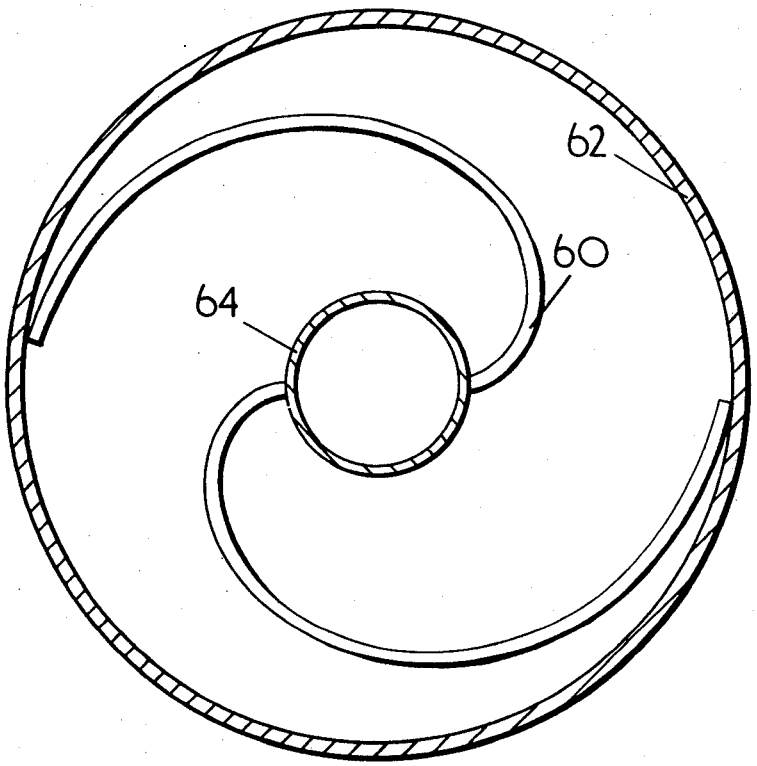
FIG. 6 is a plan view of a sixth form of heat exchanger assembly.

FIG. 6 shows a simplified sectional plan view of a heat exchanger assembly having tubes 60 of involute form arranged therein. In this sixth form of heat exchanger assembly tubes 60 are arranged in layers within an annular vessel defined by outer and inner walls 62, 64 respectively. The tubes 60 in different layers are interconnected by bends within the vessel and the top and bottom tubes are connected to headers within the inner wall 64 of the vessel. Only two tubes 60 have been shown in FIG. 6.

FIG. 7 shows a sectional view of the sixth form of heat exchanger assembly illustrated in FIG. 6. The section illustrated is across a diameter within the inner wall of the annular vessel and thence on an imaginary surface in which the centre lines of one assembly of inter-connected tubes lie. The reference numerals 70 72, indicate the two headers referred to in relation to FIG. 6.

Figure 8:
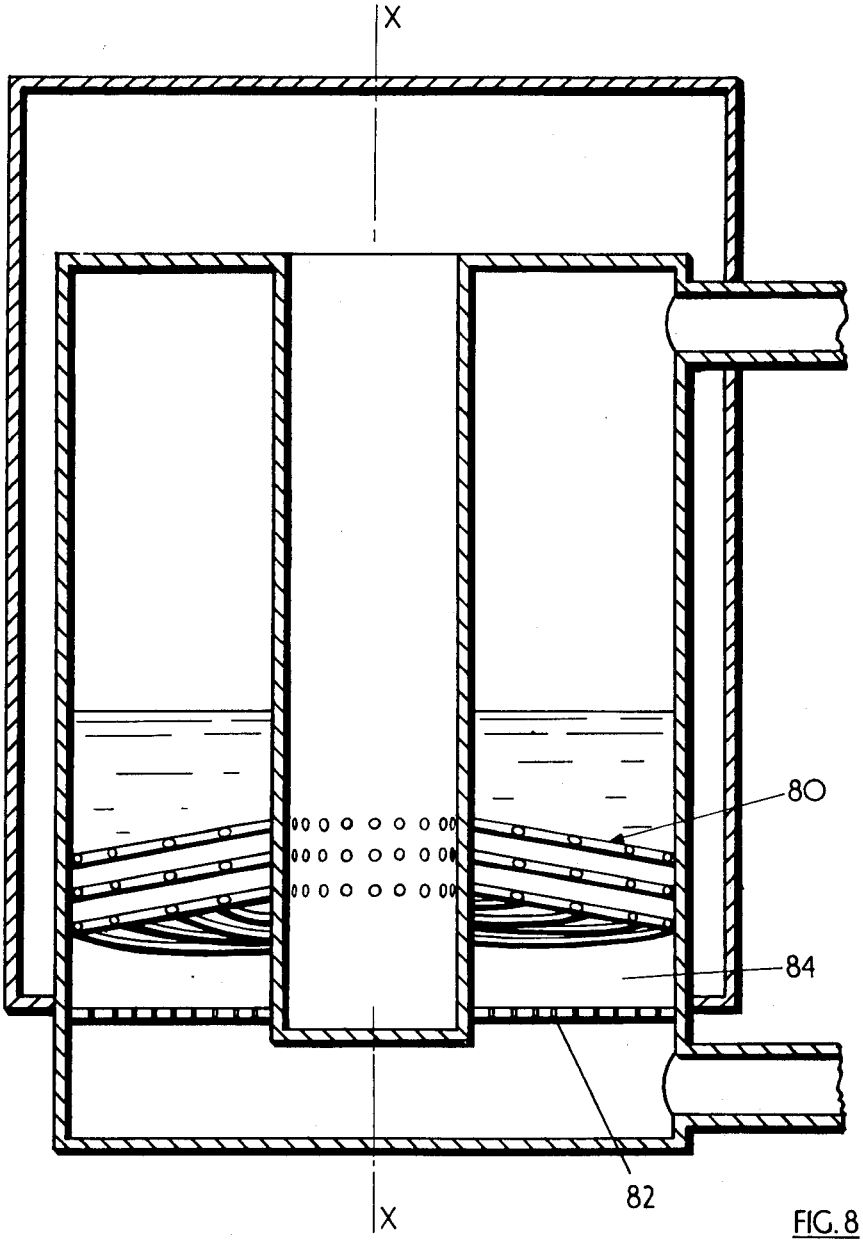
FIG. 8 is a vertical sectional view of a seventh form of heat exchanger assembly.

In FIG. 8 there is shown a seventh form of heat exchanger assembly which is a fluidised bed combustor. Tubes 80 of involute form are installed in a single pass arrangement within the annular vessel. In this form of the invention, the tubes are arranged in layers which have their centre-lines lying on cones or other surfaces of revolution about the axis X—X of the vessel. Such an arrangement might advantageously be used in a fluidised bed boiler with natural circulation of the water. A gas distributor plate 82 is located between the inner and outer walls of the vessel and a fluidised bed is indicated at 84.

By way of example, an air heater with fluidised bed combustion for a 70 megawatt gas turbine might be designed to incorporate the features shown in FIG. 4 and FIG. 2*b*. The heat exchanger tubes are one inch outside diameter and the vertical pitch of the tube layers is one and a quarter inches. The horizontal pitch of the tubes in each layer is three inches. The annular bed is four feet inside diameter and fourteen feet outside diameter, the fluidised bed depth is twelve feet and the successive layers of heat exchanger tubes occupy the top ten and a half feet of the bed. Fuel, introduced into the bed by means not shown, is burnt in air supplied through the air distributor at the base of the bed.

This air and the gaseous products of combustion fluidise the particulate material of the bed. A major part of the heat generated is transferred to air passing through the tubes. The cylinder forming the inner wall of the annular bed is divided by a diaphragm half way up the tube bank. Air enters the cylinder from below the diaphragm and passes outwards through the tubes in the lower part of the tube bank. The air then passes into an annular space surrounding the outer wall of the annular bed, inwards through the tubes in the upper part of the tube bank and passes into the space within the upper part of the cylinder above the diaphragm whence it is conveyed by a duct to the turbine. The fluidised bed air heater described above is enclosed in a cylindrical pressure vessel.

The advantages of using tubes of involute form in the above described embodiments are to make the heat exchanger assembly as compact as possible and to allow expansion effects to be easily absorbed by changes in tube curvature.

I claim:

1. A heat exchanger assembly including vessel having an outer wall and an inner wall and a group of heat exchanger tubes arranged within the vessel, the tubes each being of the same involute form and extending between the outer and inner walls, the tubes having outer and inner ends, the tubes being secured at their outer ends to the outer walls and at their inner ends to the inner wall, a gas permeable support plate for supporting a fluidized bed of particulate material and located between the outer and inner walls of the vessel.

2. An assembly according to claim 1 in which the vessel is annular and the outer and inner walls are of circular cross-section.

3. An assembly according to claim 1 in which the inner wall is tubular, and inlet header and an outlet header are provided within the inner wall in fluid flow communication with the inner ends of the tubes, and an annular chamber is provided circumjacent the outer wall and in fluid flow communication with the outer ends of the tubes.

4. An assembly according to claim 1 in which an annular chamber is provided circumjacent the outer wall, an inlet header and an outlet header defined within the chamber, the headers being in fluid flow communication with the outer ends of the tubes, the inner wall is tubular and is closed at each end, and a cavity within the inner wall in fluid flow communication with the inner ends of the tubes.

5. An assembly according to claim 1 in which an annular space is defined between the inner and outer walls of the vessel, the annular space is closed at one end thereof by the support plate and is closed at the other end remote from said one end, a plenum chamber is defined in the vessel beneath the support plate, an annular chamber is provided circumjacent the outer wall of the vessel to communicate with the outer ends of the tubes, the chamber extending over one end of the vessel, the inner wall is tubular and is closed at one end adjacent the support plate, and the inner ends of the tubes communicate with the inner wall.

* * * * *